US006760210B1

(12) United States Patent
Abramov et al.

(10) Patent No.: US 6,760,210 B1
(45) Date of Patent: Jul. 6, 2004

(54) MULTI-FUNCTIONAL SYSTEM FOR DEMAGNETIZING FERROMAGNETIC OBJECTS

(76) Inventors: Jury Vasilievich Abramov, Ul. Shakhmatcva d. 4/1 kv. 70, 198904 St. Petersburg (RU); Vladimir Nikolaevich Parkohmenko, Pr. Khudozhnikov, d. 30/2, kv. 55, 194352 St. Petersburg (RU); Vero Nikolaevna Shkodskikh, Pr. Marshala Zhukova d. 56/1, kv. 57, 198251 St. Petersburg (RU); Vitaly Vasllievich Kharitonov, Pr. Morisa Toreza, d. 9, kv. 273, 194021 St. Petersburg (RU); Nikolai Vasillevich Veterkov, Ul. Sedova d. 86, kv. 66, 193171 St. Petersburg (RU)

( * ) Notice: Subject to any disclaimer, the term of this patent is extended or adjusted under 35 U.S.C. 154(b) by 0 days.

(21) Appl. No.: 09/355,271

(22) Filed: Sep. 8, 1999

Related U.S. Application Data

(63) Continuation of application No. PCT/RU98/00165, filed on Jun. 2, 1998.

(30) Foreign Application Priority Data

Aug. 22, 1997 (RU) ..... 97114630

(51) Int. Cl.[7] ..... H01H 47/00
(52) U.S. Cl. ..... 361/149; 361/143
(58) Field of Search ..... 361/149, 267

(56) References Cited

U.S. PATENT DOCUMENTS 4,734,816 A * 3/1988 Guillemin et al. ..... 361/149
4,993,345 A 2/1991 Feldman ..... 114/240 R
5,952,734 A * 9/1999 Gelbien ..... 307/104
5,973,606 A * 10/1999 Maitin et al. ..... 340/551

FOREIGN PATENT DOCUMENTS

FR 2 587 969 4/1987 ..... 361/149

OTHER PUBLICATIONS

"Mine Warfare Round Up" NAVY International, vol. 94, No. 6. Published Maritime World Limited. Walters. Jun. 1989.

<<Istoria razmagnichivaniya korablei sovetskogo voenno-morskogo flota>>, Tkachenko B. A. et al. Published Nauka. Leningrad, 1981.

"Udarnye unipolyarnye generatory", Glukhikh V. A. et al. Published Energoizdat. Leningrad, 1987.

"Mine Warfare Round Up" NAVY International, vol. 94, No. 5, Published Maritime World Limited. Walters, 1989.

* cited by examiner

*Primary Examiner*—Brian Sircus
*Assistant Examiner*—Boris Benenson
(74) *Attorney, Agent, or Firm*—Randall E Murphy

(57) ABSTRACT

The present invention relates to demagnetizing objects in a fusion cake, objects used in vehicle construction, turbines, diesel engines and other equipment. A system of the present invention comprises four rectilinear working conductors in the shape of busbars which are assembled in pairs on each lateral side of the object to be treated over the whole length thereof, wherein said busbars are arranged one above the other at a distance determined by the object height. The system also comprises power supply modules and side working modules supporting the working busbars. Unipolar generator can be used for power supply. The side modules can be transformed to enable processing of objects having various widths, heights and lengths. The system can be transported over land, and, when the module bodies are made water-tight, it can be used for processing floating objects and transported by sea. The system of the present invention further comprises sensors for measuring the magnetic field in the transverse section of the object over the whole length thereof. The system may be used for processing an object by applying a common vertical field, an inclined field and a horizontal field, by applying a local field in the region where ferro-magnetic mass is concentrated, or by applying a longitudinal field.

14 Claims, 7 Drawing Sheets

MULTI-FUNCTIONAL SYSTEM FOR DEMAGNETIZING FERROMAGNETIC OBJECTS

This application is a continuation of PCT/RU98/00165 filed Jun. 2, 1998.

FIELD OF INVENTION

The present invention applies to technology of demagnetization of objects which are afloat, of transport engineering objects, and can also be used for demagnetization of such items, as turbines, diesels, etc.

DESCRIPTION OF PRIOR ART

The most widely used technical facility for demagnetization of large objects is a multiturn operating winding in the form of a solenoid, ring, frame, etc., supplied with power from an external source and arranged inside a structure into which the object is placed; or it could be fitted around the object for some time.

One known example is a demagnetization stand /Navy international, v, 94, No.6, 1998, p.269–270 which is a round-shape structure, or adit, and the object to be demagnetized is placed inside it. The stand is equipped with operating windings in the form of transverse framing, comprising a solenoid with the length slightly exceeding that of the object.

The drawback of this stand is the necessity for high capital investments required to build the structure plus expenditures for purchasing and mounting of the cables. The total cable length in this case amounts to many kilometres (the operating winding cable length required for a stand of 30 m diameter and 200 m length will be 30×3.14×200=18, 840 m).

Another known example is stand where the operating windings—solenoid are made in the form of a ring. Demagnetization is effected by pulling the object through this ring.

Here again large expenditures are required for building a deep-water embankment, a ring to be anchored to the bottom, the cables. Besides, such a stand is not suitable for demagnetization of floating objects with superstructures and masts.

Also well known is a system of ship demagnetization /U.S. Pat. No.4993345, B 63 G 9/00, 19 Feb. 1991 where a cable-type operating winding is applied temporarily around the ship over its waterline in horizontal plane. The winding is kept afloat by buoyancy elements. The ends of operating winding cable are connected to a power source.

The shortcoming of the system is the lack of operating winding fixation at a specified distance from the ship hull, which impairs the quality of demagnetization. The single-turn system does not permit to generate a uniform field over the whole height (depth) of the ship.

Another such system /V. A. Tkachenko. History of Soviet Navy ships demagnetization. L., "Nauka", 1981, p.53/is intended for demagnetization (degaussing) of large objects—warships; here they fit to ship plating above the waterline a degaussing coil consisting of several turns of cable. The coil is energized with direct current. To measure the magnetic field, a boom with measuring sensors is pulled along under the ship bottom. The boom is installed in one of cross-sections under the ship, its ends are fastened with wire ropes suspended from the buoyancy elements which are afloat at the starboard and port sides of the ship.

The drawbacks of the system are manual winding of the cable and impossibility to obtain the required accuracy of measurements of the ship magnetic field due to oscillations of sensors even at slight seas, to rolling of the ship and buoyancy elements.

It is customary in the world practice to use in operating windings (coils) electric cables with copper cores, and such cables are quite expensive. In temporary application of such operating coils at die objects the sable cannot be used more than 2 or 3 times, as due to multiple bends the electrical insulation fails.

To summerize the essential drawbacks of the demagnetization systems indicated above, these are the need for capital stationary structures and enourmous lengths of cables. When operating cable coils are wound on the object by hand, the labour input and duration of work are quite considerable, which results in the increase in the total demagnetization time. Such systems are not Suitable for demagnetization of transport engineering products, also for such items, as turbines and diesels. The devices for magnetic field measurements at the objects to be demagnetized require futher development.

The most close to the system for warships is a system developed for degaussing of ferromagnetic objects and containing operating coils with rectilinear busbars which are placed so that they make it possible to demagnetize a sea-going ship in three directions. It also contains a power supply unit for energizing of operatying coils, a device for measuring the ship's magnetic field characteristics and a carrier incorporating the system's components /FR N 2587969 B 63 G 9/06, 03.04.87/.

However, the above system is not sufficiently unified and mobile which makes its practical use limited.

SUMMARY OF THE INVENTION

The goal of the present invention is development of an object demagnetization system which will be free from the drawbacks indicated above.

This goal is achieved by using a ferromagnetic object demagnetization system containing an operating coil with four rectilinear main busbars connected with four jumpers; the busbars are mounted, two on each side, over the whole length of the object, one above the other at a distance determined by the object's height. The system also contains a power source for energizing the operating coil and a device for measuring the characteristics of the ship's magnetic field and presentation of initial data for processing of the above field. There is also a carrying device intended for incorporation of the system's components and constructed from rigidly connected modules with framework made of non-magnetic materials. The power source is located inside the power-generating module, the operating coil and device for measuring the characteristics of the ship's magnetic field are fitted in the pair of side working modules. The butt face devices are designed to provide rigid connection between the power-generating module and side working modules with the use of movable fixation locks. The jumpers mentioned above are mounted in the butt face devices and provide a possibility for switching-over the ends of main busbars in accordance with specified current direction.

Some essential particular features helped in solution of the set task.

The power source for power supply to the operating winding (coil) has been designed as a strong-current generator, such as unipolar generator.

The main busbars of each side module are also its structural elements.

The side working modules are positioned with a possibility of changing the distance between them by means of mechanical movement and fixation with locks.

The main busbars in the side working modules have been mounted with a possibility of changing the distance between them in height with the aid of a drive.

The side working modules have been designed with a possibility of pairwise connection to increase the length of the main busbars.

The power module and side working modules are provided with an arrangement for their transfer over the land, for instance, using wheels.

The power module and side working modules are made watertight, with a possibility of transportation over water and demagnetization of floating ferromagnetic objects.

The jumpers are mounted with a possibility of switching-over the ends of main busbars with the aim of creating vertical, sloping, horizontal magnetic fields acting on the object and switching-over the power source contacts for changing of magnetic field direction.

Each side working module carries an electromagnetic coil consisting of two frames mounted symmetrically on both sides of the object to be demagnetizad in vertical planes parallel to its axis. A possibility is provided for processing of the ferromagnetic mass concentration area by focused lateral magnetic field in the course of object movement. The current from the power source to the coil frames is supplied with the aid of main busbar elements and conductors laid down in bifilar pattern.

In top and bottom parts of each side working module longitudinal guides are fitted for movement of carriages of mobile components; the sensors of the object's magnetic field measuring device are mounted on the above carriages and have a possibility of volumetric measurements of the magnetic field over the whole length of the object to be demagnetized.

Within the plane perpendicular to the object's longitudinal axis a coil is installed with a possibility to process a cylindrical object moving through the coil along the longitudinal axis. The current from the power source is supplied to the coil via the elements of main busbars and conductor laid down in bifilar pattern. The sensors of the device measuring the magnetic field characteristics are located over the coil perimeter.

BRIEF DESCRIPTION OF THE DRAWINGS

The invention is illustrated by FIGS. 1–20.

DESCRIPTION OF THE PREFERRED EMBODIMENT

Figure 1:
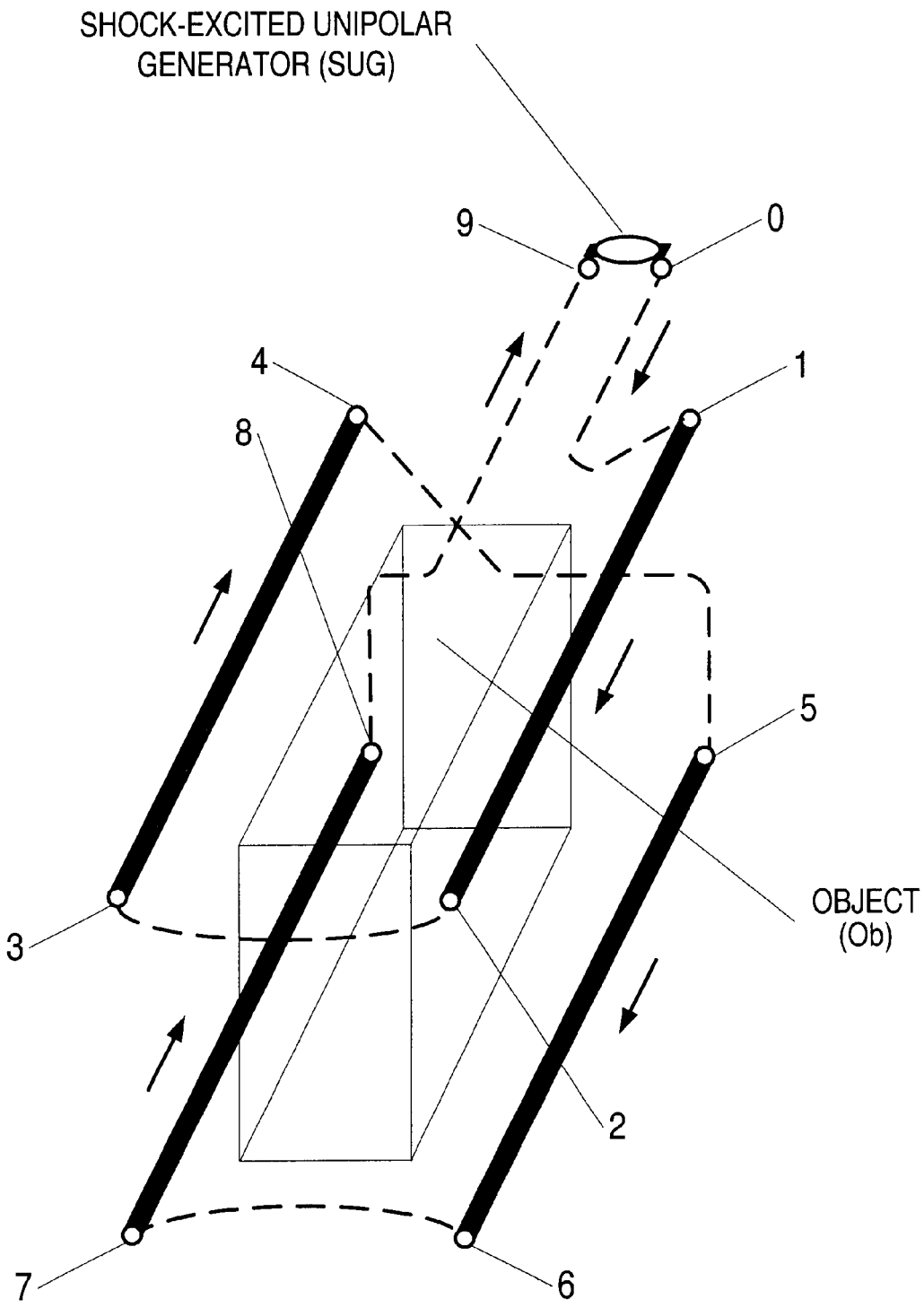
FIG. 1. is line diagram of tile suggested system for degaussing of ferromagnetic objects.

The operating winding, or coil (FIG. 1) is made of four rectilinear working conductors (1–2, 3–4, 5–6, 7–8) in the form of busbars of random cross-section, located in pairs on both sides and along the whole length of the treated objects (Ob), parallel to each other and one above the other, at a distance depending on the object height; they connect the working conductors of jumpers (0–1, 8–9) and (2–3, 6–7) connected to the ends of working conductors depending on the current direction specified for them.

The efficiency of system operation after replacement of multiturn working winding employing cables having copper cores with a working coil in the form of individual main conductors, or busbars, made of a cheaper material, such as Al Mg alloys, is ensured by using a higher current in the operating coil and a shock-excited unipolar generator (SUG) as the main current source /B. A. Glukhikh et al. Shock-excited unipolar generators. L., Energoizdat, 1987, p. 12–23/.

Figure 3:
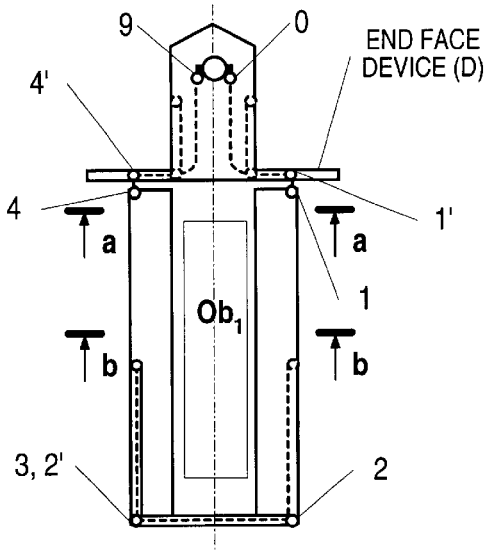
FIG. 3. shows transformation of the system into operational condition, with the object to be treated inside it, FIG. 4, a—a (letters designate sectional views) shows movable fixation electric locks 4' and 5' of contacts 4 and 5 of the system.
Figure 4:
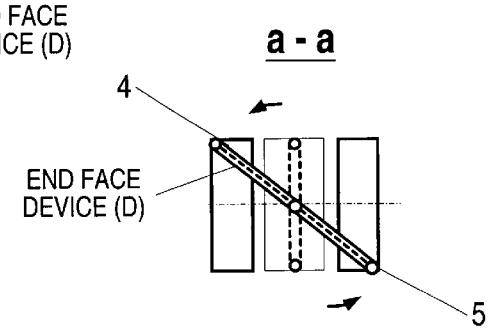

The carrier component of the system is composed of self-contained modules (FIG. 2) power-generating module (PM) containing a current source for supply of operating coil, and arranged in parallel side working modules (W 1 and WM 2), each carrying a pair of main conductors in operational condition (FIG. 3, FIG. 4, a—a) the object to be magnetized (Ob 1) is placed between the side modules; another important component is butt face devices (D) carrying the jumpers and interlocking rigidly the power module and side working modules with movable fixation electric locks (1',2', . . . 8').

Structurally, the modules are made of nonmagnetic materials, such as AlMg alloys. Rectilinear main conductors, busbars (1–, 3–4, 5–6, 7–8) are manufactured as load-bearing elements of the module design, electrically insulated from the module hull.

When the modules are produced from GRP, the main conductors perform an additional function of embedded fittings.

The ferromagnetic objects to be demagnetized can differ from each other in overal dimensions-height, breadth, length.

Figure 5:
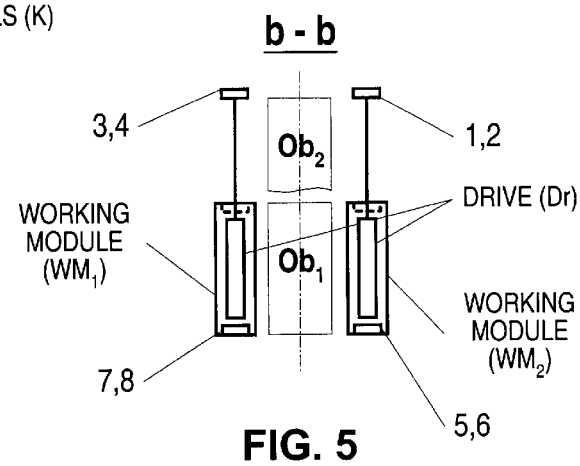
FIG. 5, b—b shows transformation of the system for treatment of large height objects.

For the purpose of demagnetization of an object (Ob 2) of increased height (FIG. 5, b—b) the main conductors of the side working modules (WM1, WM2) are designed with a possibility of changing the distance between them in height with the aid of a drive (Dr).

Figure 6:
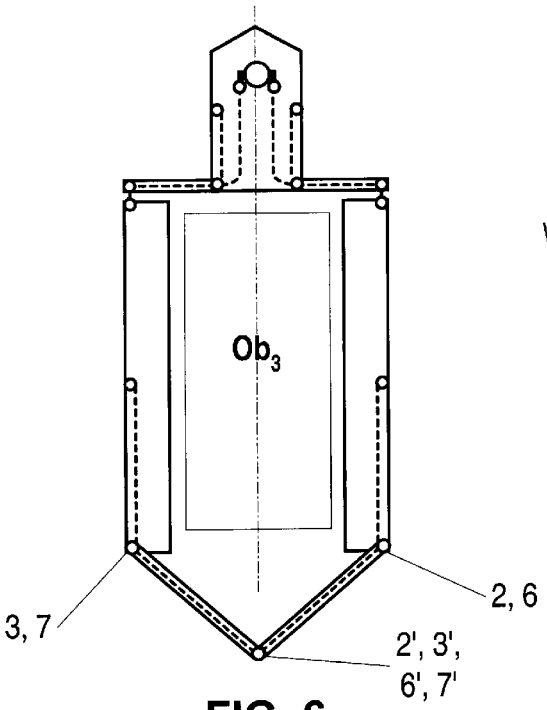
FIG. 6 shows transformation of the system for treatment of large breadth objects.

For the purpose of demagnetization of an object (OB3) of increased breadth(FIG. 6) the side working modules can be moved apart mechanically, with subsequent fixation of them in this position using the electric locks of the butt face devices.

Figure 7:
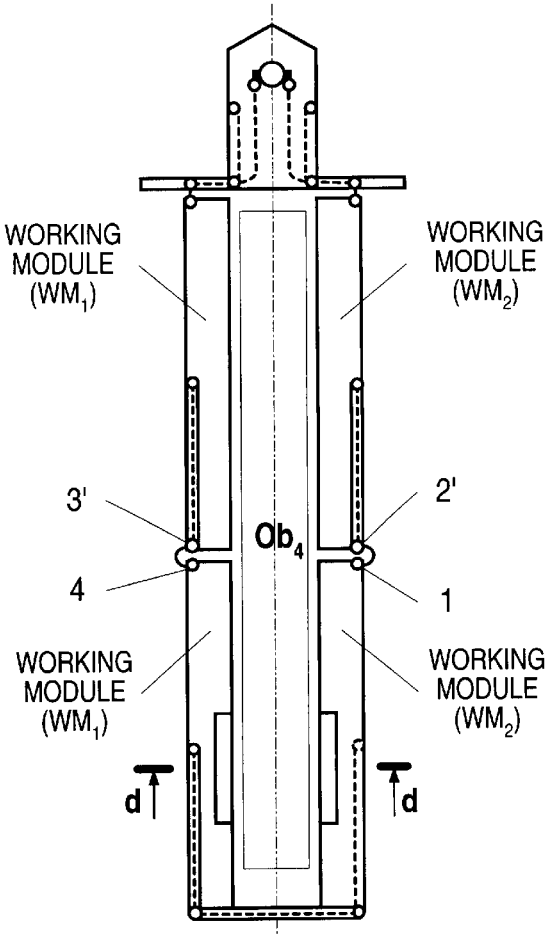
FIG. 7 shows transformation of the system for treatment of large length objects.

For the purpose of demagnetization of an object (Ob 4) of increased length (FIG. 7) the required length of main conductors cans be obtained by joining of additional side working modules (WM1+WM1), (WM2+WM2) and fixation of them with the aid of electric locks.

Figure 8:
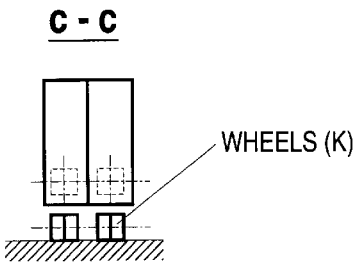
FIG. 8, c—c shows the equipment of the system for transportation over land.

The above systems are suitable for transport engineering objects, also for turbines, diesels and other such products. For transportation of the systems over land (FIG. 8, c—c) the power module and side working modules are provided with wheels (K) or other facilities.

Figure 9:
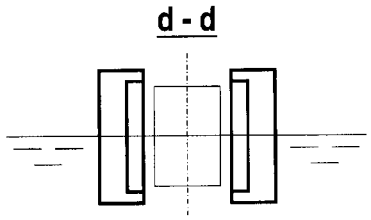
FIG. 9, d—d, shows watertight modules and floating object of box shape.

For the purpose of demagnetization of floating objects the hulls of power module and side working modules are made watertight, which allows their transportation by water (FIG. 9, d—d).

Figure 10:
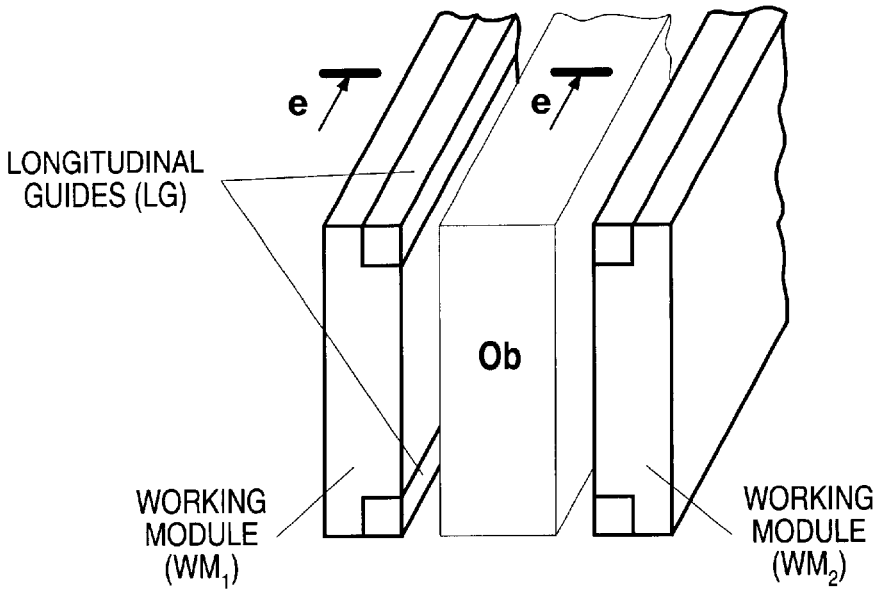
FIG. 10. shows longitudinal guides for carriages of mobile mechanisms.
Figure 11:
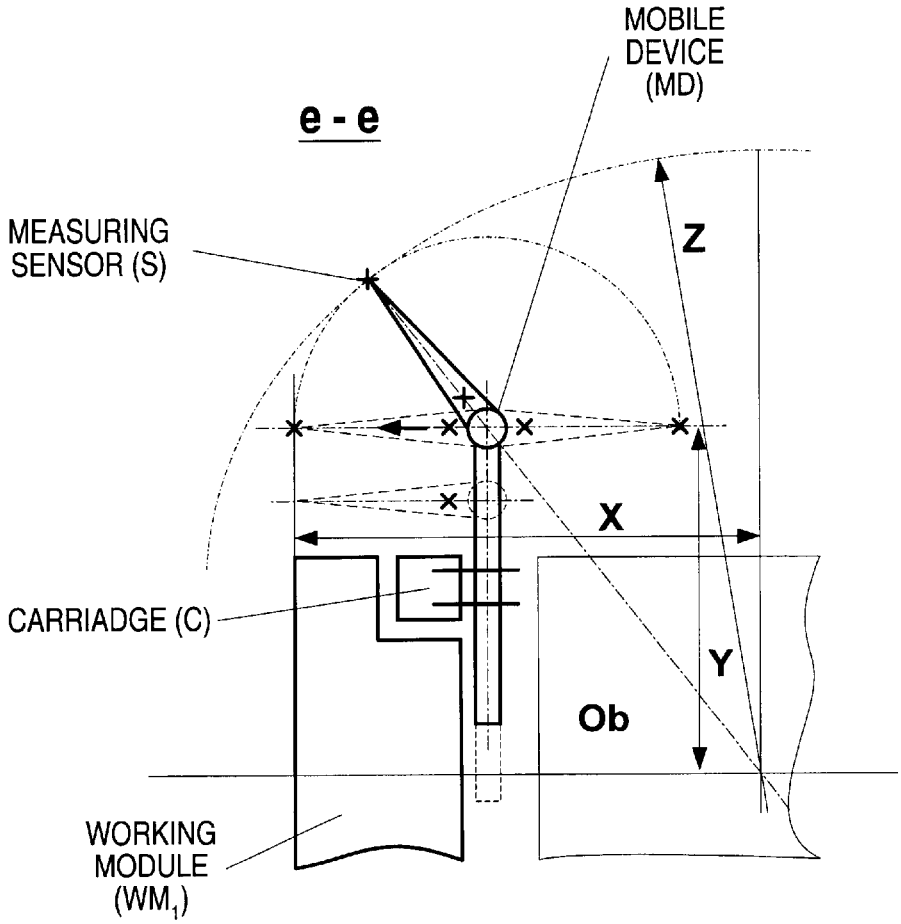
FIG. 11, e—e, shows location of sensors on mobile devices for measuring of magnetic fields.

For measuring of magnetic field of objects (Ob) to be treated side working modules (WM1, WM2) are fitted at their upper and lower parts over their whole length (FIG. 10.) with longitudinal guides (LG), on which (FIG. 11, e—e) carriages (C) are mounted with mobile devices (MD) carrying sensors (S), for measuring of magnetic field in transverse sections at distances X, Y, Z from the longitudinal axis of the object; therefore, travel of the mobile devices provides volumetric measuring of the magnetic field over the whole length of the object. In some cases the mobile devices with sensors are used only below (under the object) or only in the upper part.

One more feature of the proposed system should be noted.

It is well known that if we subject a ferromagnetic plate to action of electromagnetic field, the efficiency of magnetization will depend largely on position of the plate in relation to magnetic field direction. When the plate is positioned along the field, the effect of its magnetization will be higher, than when it is placed across the field.

Let us consider, with this fact in mind, the use of above system for treatment of a floating object of, for instance, box shape.

Figure 12:
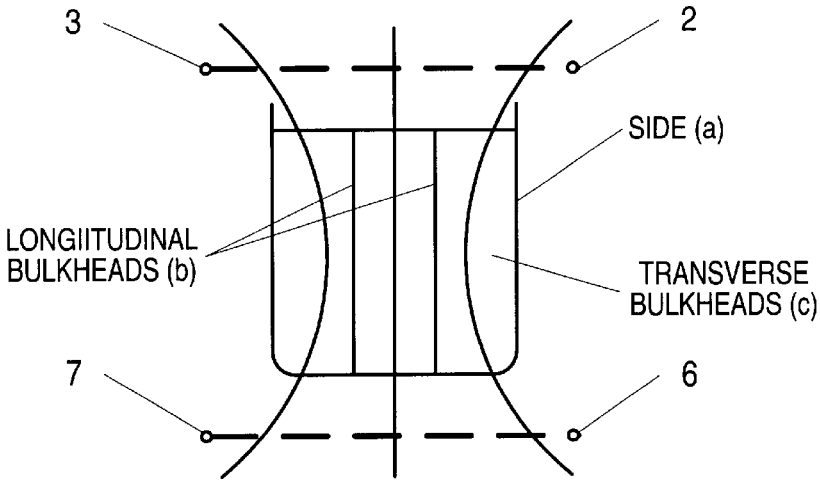
FIGS. 12–14 show possible patterns of connection of main busbar's ends by means of jumpers.

First, let us connect the ends of the system's main conductors with jumpers using pattern "2–3 and 6–7" (FIG. 12).

The system will form a vertical processing field In this case the vertical structures of the object—sides (a), longitudinal (b) and transverse (c) bulkheads will be treated more efficiently, than decks and bottom, which are in horizontal planes.

Figure 13:
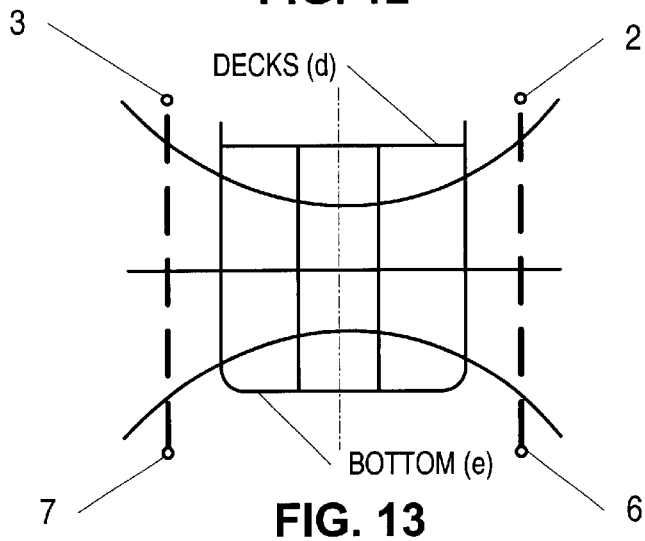

Secondly, let us connect the ends of main conductors in the same system using pattern "2–6 and 3–7" (FIG. 13)

The system will form a horizontal transverse field of processing. In this case more efficiently will be treated the decks (d) and bottom (e), lying in horizontal planes, less efficiently—sides, longitudinal and transverse bulkheads, as located in vertical planes.

Figure 14:
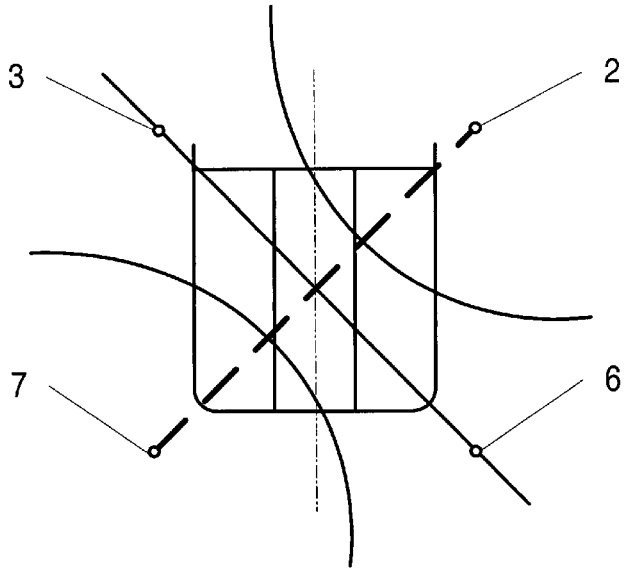

Thirdly, let us connect the ends of operating coils in the system first by pattern "2–7", then by pattern "3–6" FIG. 14).

In tis case the system will form sloping processing fields, and both vertical and horizontal object hull structures will be treated with practicaly the same efficiency, at the same angle.

Therefore, by switching the ends of main conductors over with the use of jumpers it is possible to provide action on the object of vertical (FIG. 12), sloping (FIG. 14) and horizontal (FIG. 13) fields, i.e. treatment is done by rotating field (in essence); and when switching the operating coil at the contacts of power source from "0–9" to "9–0" the field direction is reversed. Such multifunctional capability allows to select the optimum version of high-quality demagnetization of the object as a whole.

Figure 15:
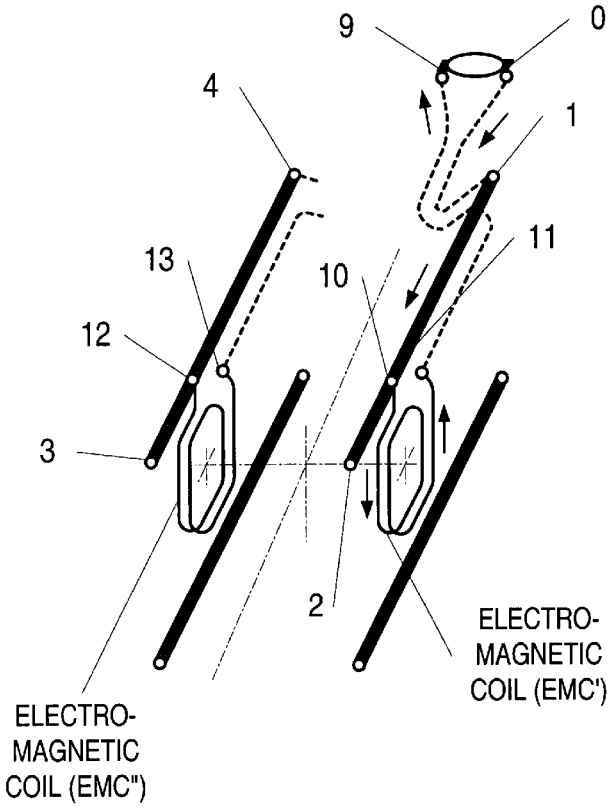
FIG. 15 is the line diagram of the object's ferromagnetic mass demagnetization.
Figure 16:
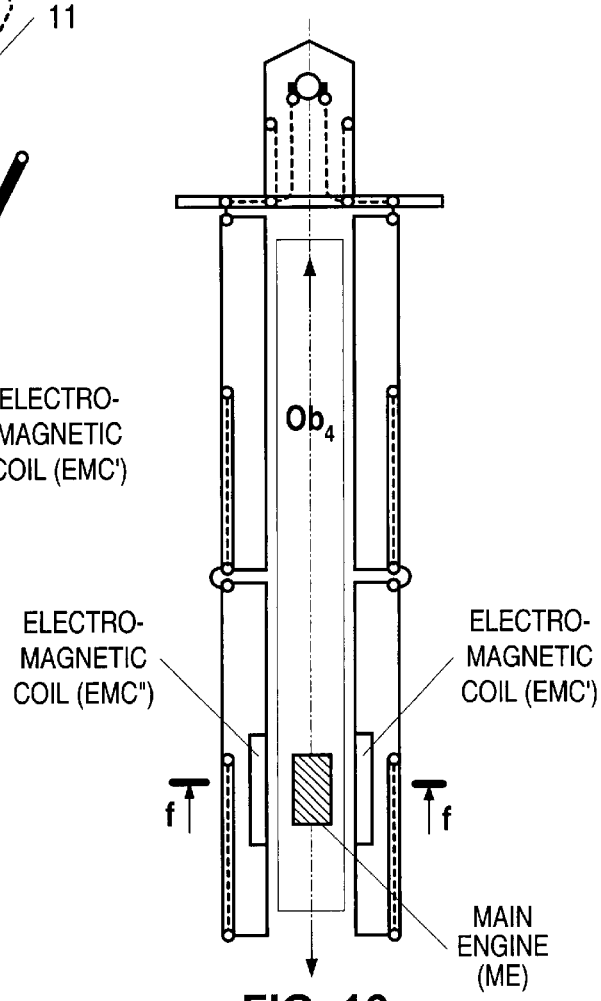
FIG. 16 is diagram of object movement in the course of treatment of concentrated ferromagnetic mass.
Figure 17:
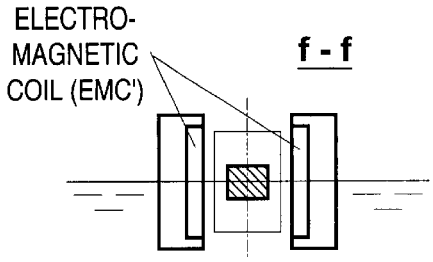
FIG. 17, f—f, shows location of coil frames.

In cases when the ferromagnetic mass of the object under treatment is distributed non-uniformly over the object's length (FIGS. 15–17), for instance with the ferromagnetic mass concentration most high in the form of a main engine (ME) in the engine room of the object, such area is treated by a transverse focused field created by an electromagnetic coil (EMC) located in the side working modules. The coil is constructed in the form of frames (EMC' and EMC") which are elements of main busbars having several turns; the frames are mounted symmetrically on both sides of the objects in vertical planes of working modules. The current for the coil is supplied to contacts 10–11 and 12–13 via the main busbars and bifilarly-laid conductors. Treatment of the area (ME or similar items) is effected by moving the object in relation to transverse focused field created by the coil.

Let us now consider in the same way, as was used for an object of box shape, the treatment by the same system of an object (floating object) of cylindrical shape.

As in the latter object the principal mass of structures is concentrated within the cylinrical part of the object—hull plating extended along the object's longitudinal axis, the treatment of such object is best done by longitudinal field.

Figure 18:
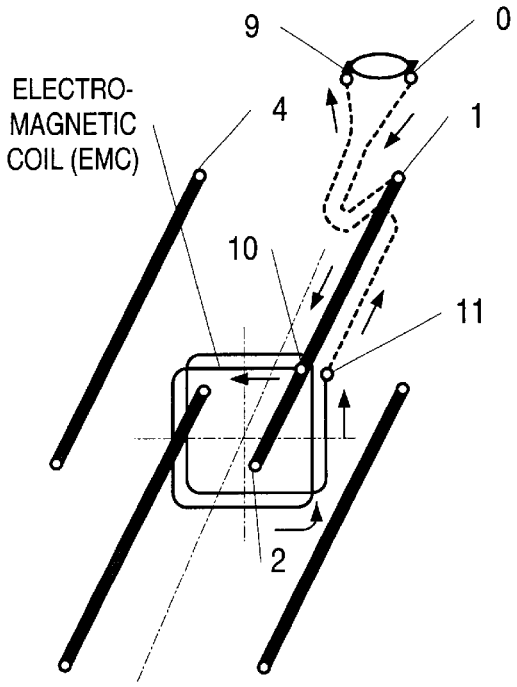
FIG. 18 is line diagram of demagnetization of a cylindrical object.

To create the longitudinal field the main conductors are maid in the form of a frame (FIGS. 18, 19) of several turns, i.e. electromagnetic coil (EMC) mounted within a plane perpendicular to the longitudinal axis of the object. The current to contacts 10–11 of the coil is supplied via the main (1–2) and bifilarly-laid (9–11) conductors. The treatment is effected by pulling the object through this coil. The measuring sensors (D) are located over the perimeter of operating frame EMC (FIG. 20, g—g). Measuring of the field and treatment of the object are achieved by moving the object through the EMC frame.

Figure 19:
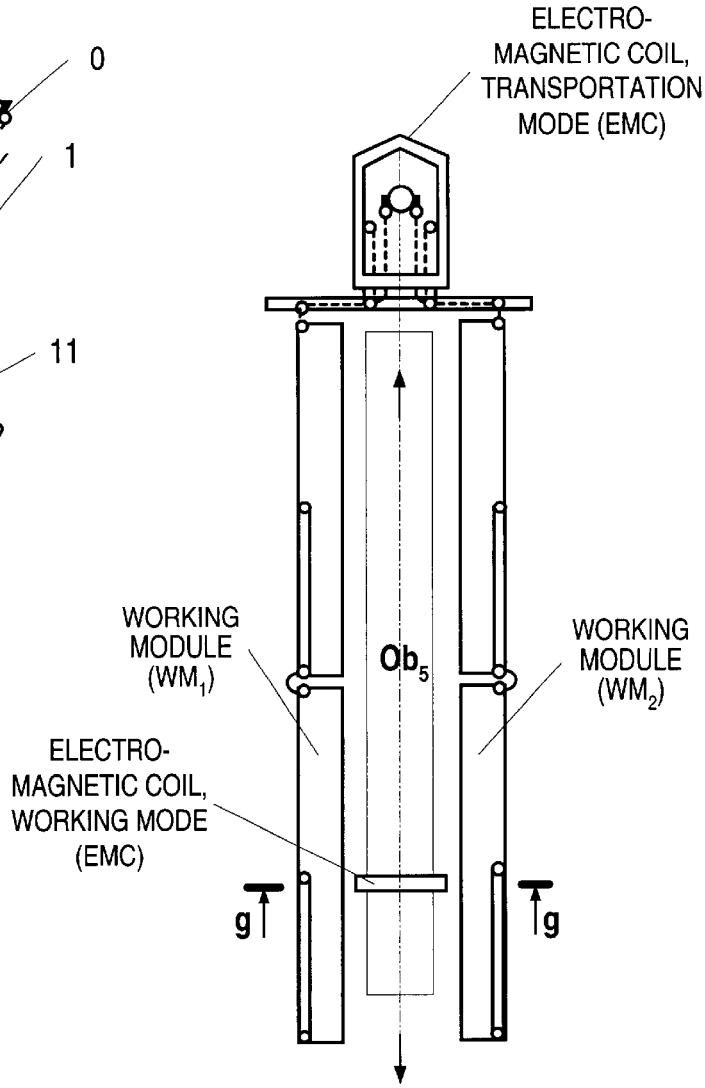
FIG. 19 is diagram of cylindrical object movement in the course of treatment.
Figure 20:
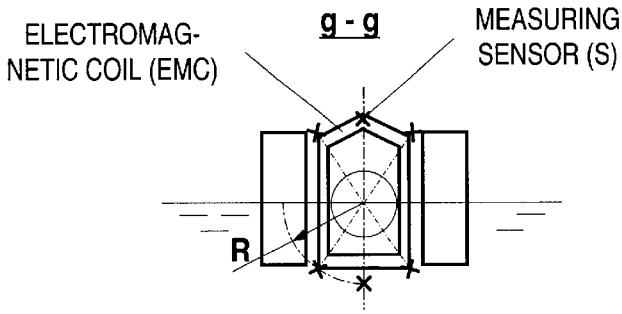
FIG. 20, g—g, shows positioning of a coil frame with sensors on it for magnetic field measurements

When in transportation mode, the EMC frame intended for treatment of cylindrical objects is stowed on the deck of the power module (FIG. 19). To bring the system into its working mode, the power module is first positioned between the two working modules. The frame is lifted from the power module deck by a special hoisting device fastened on the side surfaces of the working modules near contacts 10–11. Then the power module is taken away, the frame is turned in vertical plane and positioned perpendicular to the object's longitudinal axis.

This means that the system is multifunctional not only because it can create a rotating processing field, but also because it allows to treat the concentrated ferromagnetic mass of the object and makes it possible to treat the object by longitudinal field.

When demagnetizing transport engineering objects, turbines, diesels and other items, the system (FIG. 1) in its transportation mode (FIG. 2) is orientated in relation to the meridian and, depending on the object's overall dimensions, is put into one of its working positions (FIGS. 3–7). First of all the jumpers of the butt face devices at the power module (1—1, 8—8) are turned around contacts 1 and 8 until they are matching the contacts 1 and 8 of the side working nodules, then fixation with locks 1',8' takes place. Simultaneously contacts 4 and 5 (FIG. 4) are closed and fixed by locks 4' and 5'. Subsequently, from the side of opposide working module the ferromagnetic object to be treated is brought in and placed between the side modules WM1 and WM2. Then the jumpers of the butt face device are turned around contacts 3 and 7. The object is in, the operating winding of the system is ready.

Measuring of the object's magnetic field in the transverse section (FIG. 11, e—e) involves taking readings from sensors (S) mounted on the mobile device (MD). Moving the mobile device along the object we obtain data on the magnetic field condition along the whole length of the object.

On the basis of data on the object's magnetic field condition and appropriate standards the ferromagnetic object is subjected to treatment by supply of current into the operating winding from the unipolar generator.

After completion of the treatment the butt face device jumpers are opened and the treated object is brought out.

Figure 2:
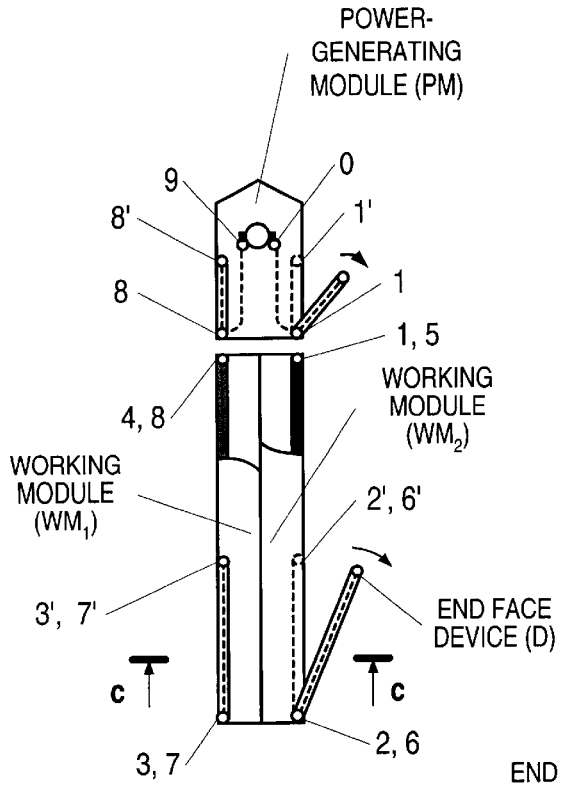
FIG. 2. is modular design (view from above) of the system, as assembled.

If the system is to be shipped ,the modules are put into their transportation mode (FIG. 2).

When demagnetizing ferromagnetic objects afloat, the system consisting of watertight floating modules is put into the respective position (an example is shown in FIG. 9). The water area in this place must have a sufficient depth and be equipped with anchored buoys allowing to define the position of the floating system in reference to the cardinal points. Reception of the floating ferromagnetic object into the system, measuring of magnetic field, treatment of the object and its exit from the system are carried out in the way described above; the treatment is done by the general field within the length of the rectilinear main conductors.

When demagnetizing box-shaped floating ferromagnetic objects a necessity could arise for additional treatment by sloping or horizontal fields: this is achieved by switching-over the jumpers at the butt face devices of the system.

Treatment of a concentrated ferromagnetic mass of the object is done by action of a transverse focused field, the object being moved between the side working modules in relation to the EMC within the mass location boundaries.

Measuring of the magnetic field and treatment of a cylindrically-shaped floating ferromagnetic object is done by pulling it between the side working modules through the EMC frame.

INDUSTRIAL APPLICABILITY

The proposed system can be widely applied for demagnetization of various objects, because in comparison with other existing systems of demagnetization it is:

- economical in manufacture, because it needs no cable for construction of operating windings and the general design is simplified;
- modular design allows to transform the system and to treat objects with various overall dimensions;
- the system allows treatment of objects on land and objects afloat;
- use of a unipolar generator as a power source allows to provide higher levels of energy and, respectively, considerably higher quality of electromagnetic treatment of the object;
- the mobility of magnetic field system makes it possible to coordinate it with the power source control system, to automate the object treatment process and to reduce the total cycle.

What is claimed is:

1. A system for demagnetization of ferromagnetic objects comprizing:

an operating winding having four rectilinear main busbars connected by jumpers and placed in pairs on each side and over the whole length of the object to be demagnetized, the busbars being mounted one above the other at a distance determined by the object height;

a power source for energizing the operating winding;

a device for measuring the object's magnetic field characteristics, arranged to present an initial data for treatment of the object; and a carrier arrangement for accommodating the system components;

wherein the carrier arrangement includes rigidly joined modules made of non-magnetic material; the power source is located in the power generating module; the operating winding and the device for measuring the object's magnetic field characteristics are located in a pair of side working modules; and wherein end face devices are further provided to enable the rigid connection of the power module and side working modules by means of movable fixation locks; and said jumpers are fitted in the end face devices to permit switching over the main busbars ends in accordance with the predetermined direction of the current in the busbars.

2. The system according to claim 1, wherein the power source for energizing the operating winding is a strong-current generator.

3. The system according to claim 1, wherein the busbars of each side working module are structural elements thereof.

4. The system according to claim 1, wherein the side working modules are arranged so as to enable changing the distance between them by mechanical shifting and fixing by locks.

5. The system according to claim 1, wherein the main busbars in the side working modules are mounted to enable changing the distance between them in height by means of a drive.

6. The system according to claim 1, wherein the side working modules are made so as to enable their connection in pairs whereby the total length of the main busbars can be increased.

7. The system according to claim 1, wherein the power module and the side working modules are provided with means for land transportation.

8. The system according to claim 1, wherein the power and side modules are made watertight to enable transportation over water for use in demagnetisation of floating ferromagnetic objects.

9. The system according to claim 1, wherein the jumpers are mounted to enable switching over the main busbars' ends to generate vertical, sloping and horizontal magnetic fields for treatment of the object; and to enable switching over the contacts of the power source to change the direction of the magnetic fields.

10. The system according to claim 1, wherein the side working modules carry an electromagnetic coil consisting of two frames located symmetrically on both sides of the object to be demagnetized, in vertical planes parallel to the object axis, so as to enable treatment of the area in which ferromagnetic mass is concentrated by a focused transverse magnetic field in the course of the object movement, the current from the power source being supplied to the coil frames via elements of main busbars and bifilarly-laid conductors.

11. The system according to claim 1, wherein longitudinal guides are provided on top and bottom of each side working module, for guiding carriages bearing movable devices, the sensors of the device for measuring the object's magnetic field being mounted on said movable devices enabling volumetric measurement of magnetic field over the whole length of the object to be demagnetized.

12. The system according to claim 1, wherein an electromagnetic coil is positioned in a plane perpendicular to the longitudinal axis of the object to enable treatment of a cylindrically-shaped floating object when it moves through the coil along the longitudinal axis; the current from the power source being supplied to the coil using main busbars and bifilarly-laid conductors; and the sensors of the device for measuring the object's magnetic field characteristics being disposed over the perimeter of the coil.

13. The system according to claim 2, wherein the strong-current generator is a unipolar generator.

14. The system according to claim 7, wherein the means for land transportation are implemented as wheels.

* * * * *